US009344785B1

(12) United States Patent
Tracy

(10) Patent No.: US 9,344,785 B1
(45) Date of Patent: May 17, 2016

(54) SPEAKER ASSEMBLY

(71) Applicant: Dennis A Tracy, Culver City, CA (US)

(72) Inventor: Dennis A Tracy, Culver City, CA (US)

( * ) Notice: Subject to any disclaimer, the term of this patent is extended or adjusted under 35 U.S.C. 154(b) by 0 days.

(21) Appl. No.: 14/631,449

(22) Filed: Feb. 25, 2015

(51) Int. Cl.
*H04R 1/02* (2006.01)

(52) U.S. Cl.
CPC ..... *H04R 1/02* (2013.01)

(58) Field of Classification Search
CPC ..... H04R 1/025; H04R 1/24; H04R 1/26; H04R 5/02
USPC ..... 181/144, 147, 150, 199; 381/351, 184, 381/186
See application file for complete search history.

(56) References Cited

U.S. PATENT DOCUMENTS 4,182,429 A 1/1980 Senzaki
4,356,881 A 11/1982 Lowell
4,572,326 A 2/1986 Hutchins
4,899,390 A * 2/1990 Takewa ..... H04R 1/2834 181/145
5,874,695 A * 2/1999 Tracy ..... H04R 1/26 181/147
6,279,678 B1 * 8/2001 Tracy ..... H04R 1/02 181/144
6,719,090 B2 4/2004 Tracy
6,886,658 B1 * 5/2005 Rolph ..... H04R 1/2819 181/148
8,249,282 B2 8/2012 Tracy
8,256,566 B1 * 9/2012 Rodgers ..... H04R 1/2826 181/144
8,520,883 B2 * 8/2013 Tracy ..... H04R 1/02 381/182
8,682,008 B2 3/2014 Tracy
8,807,269 B1 * 8/2014 Lucy ..... H04R 1/2888 181/148
8,887,861 B2 * 11/2014 Regier ..... H04R 1/2857 181/155
2007/0291975 A1 * 12/2007 Tracy ..... H04R 1/025 381/386
2010/0054522 A1 3/2010 Maurer et al.

* cited by examiner

*Primary Examiner* — Jeremy Luks
(74) *Attorney, Agent, or Firm* — Welsh Flaxman & Gitler LLC

(57) ABSTRACT

A speaker assembly includes a rigid, structurally stable and self-supporting speaker housing, a first mid-range driver mounted within the speaker housing, a second mid-range driver mounted within the speaker housing, and a high frequency driver mounted within the speaker housing. A high frequency housing spacer is secured around the high frequency driver and positioned within the speaker housing to divide the speaker housing into separate and distinct compartments for the first and second mid-range drivers.

13 Claims, 4 Drawing Sheets

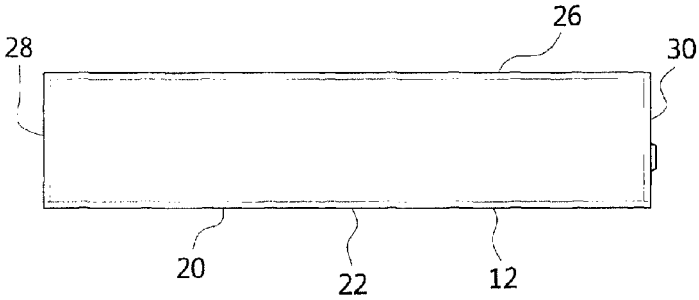
FIG. 8
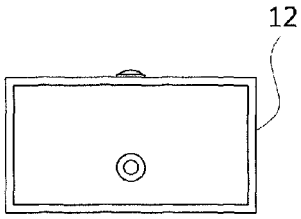
FIG. 9
FIG. 10
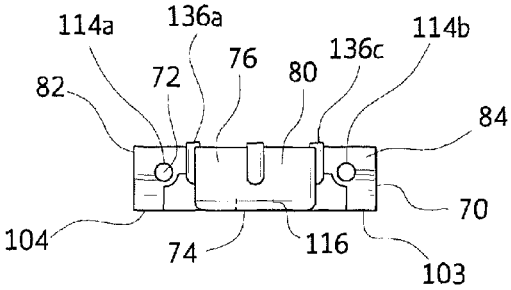
FIG. 11
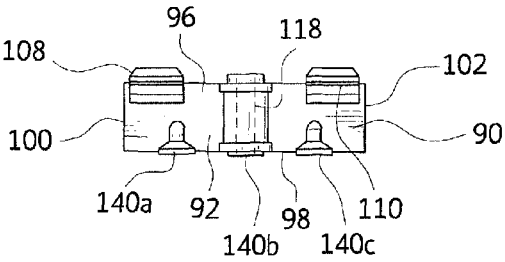

SPEAKER ASSEMBLY

CROSS REFERENCE TO RELATED APPLICATION

This application claims the benefit of U.S. Provisional Patent Application 61/944,258, entitled "SPEAKER ASSEMBLY," filed Feb. 25, 2014.

BACKGROUND OF THE INVENTION

1. Field of the Invention

The invention relates to a speaker assembly. More particularly, the invention relates to a speaker assembly with reduced size and weight, yet retaining robust structural integrity and simplified integration allowing optimum placement and excellent performance of the speaker assembly within an aircraft.

2. Description of the Related Art

The current global community has made it possible for people from around the country, and around the world, to interact for both business and personal reasons. For many people, this requires they spend considerable time traveling from one location to another location. More often than not, these people travel in aircraft.

Whether these people travel in private or commercial aircraft, they desire high quality entertainment during the many hours they spend within the confines of an aircraft. While high quality entertainment, for example, digital video with CD quality sound, is readily available for theatre and home use, the weight and size requirements for use of such equipment in an aircraft makes it very difficult to incorporate high fidelity systems within an aircraft. This problem is especially pronounced for audio speaker assemblies when one attempts to meet the size, weight and shape requirements for use in aircraft.

The aircraft industry places a high priority upon component weight and size reduction. Range and payload are adversely affected by conventional terrestrial designs. These concerns are notable when one attempts to make changes within smaller private jets. For example, a small increase in the weight carried by an aircraft results in a substantial increase in the fuel consumption of the aircraft. In addition, the limited space available within an aircraft dictates the use of available space within the aircraft be carefully considered by those responsible for ensuring the comfort of passengers.

Lightweight and compact audio speakers are currently available. These speakers, however, substantially compromise sound quality for reduction in size and weight. With this in mind, an individual wishing to add an audio system to an aircraft must make a choice between high fidelity speakers, which do not suit the size and weight requirements of the aircraft, or lower quality speakers providing desirable size and weight characteristics.

Another concern encountered in the incorporation of speakers within an aircraft is the fact the speakers are generally confined within an enclosed space offering little in the way of airflow for cooling the driving components of the loudspeakers. In addition, the small spaces available within an aircraft also dictate that the speaker housing be relatively small. This further creates heating problems as little air is available within the housing for the cooling of speaker components. As such, speakers are susceptible to overheating, which may result in damage thereto or failure of the component.

More particularly, and as those skilled in the art will certainly appreciate, the voice coil of a conventional driver generates heat which is then dissipated to the surrounding driver structure, that is, the driver magnet, etc. This heat must be "bled off" to maintain the driver at an appropriate operating temperature or the performance of the speaker will be compromised.

A need, therefore, exists for a speaker assembly providing high-fidelity sound, while also accommodating the size and weight constraints of an aircraft. The present invention provides such a speaker assembly.

SUMMARY OF THE INVENTION

It is, therefore, an object of the present invention to provide a speaker assembly including a rigid, structurally stable and self-supporting speaker housing, a first mid-range driver mounted within the speaker housing, a second mid-range driver mounted within the speaker housing, and a high frequency driver mounted within the speaker housing. A high frequency housing spacer is secured around the high frequency driver and positioned within the speaker housing to divide the speaker housing into separate and distinct compartments for the high frequency driver, the first mid-range driver and second mid-range driver.

It is also an object of the present invention to provide a speaker assembly wherein the speaker housing includes a base structure composed of a top wall, first and second lateral side walls and front and rear side walls.

It is another object of the present invention to provide a speaker assembly wherein, other than various apertures for passage of wires, the top wall, first and second lateral side walls and front and rear side walls are solid and impervious to the passage of sound waves or airflow.

It is further an object of the present invention to provide a speaker assembly wherein the speaker housing further includes a cover plate selectively secured to the first and second lateral side walls and front and rear side walls such that the base structure and the cover plate form an enclosure within which the first and second mid-range drivers, as well as the high frequency driver, are held.

It is also an object of the present invention to provide a speaker assembly wherein the cover plate includes air slots in fluid communication with a cavity defined by the cover plate and the high frequency housing spacer.

It is another object of the present invention to provide a speaker assembly wherein the high frequency housing spacer includes a base housing structure composed of a top wall, a cylindrical side wall extending from the top wall, and an open bottom, and the high frequency housing spacer also includes first and second dividing walls extending from diametrically opposed sides of the cylindrical side wall.

It is further an object of the present invention to provide a speaker assembly wherein a bottom edge of the cylindrical side wall is secured to an inner wall of the cover plate in a manner surrounding the high frequency driver and the first and second dividing walls extending from the base housing structure to the first and second lateral side walls of the speaker housing.

It is also an object of the present invention to provide a speaker assembly including a full length dividing wall positioned beneath the high frequency housing spacer.

It is another object of the present invention to provide a speaker assembly wherein the full length dividing wall includes a wall structure with first and second surfaces, a bottom edge, a top edge, and first and second side edges.

It is further an object of the present invention to provide a speaker assembly wherein the base housing structure includes a central ventilation aperture in the closed top wall and the full length dividing wall is provided with a ventilation aperture shaped and dimensioned for alignment with the central ventilation aperture formed in the closed top wall.

It is also an object of the present invention to provide a speaker assembly wherein the cover plate includes air slots in fluid communication with a cavity defined by the cover plate and the high frequency housing spacer.

It is another object of the present invention to provide a speaker assembly wherein the base housing structure includes a central ventilation aperture in the closed top wall and the full length dividing wall is provided with a ventilation aperture shaped and dimensioned for alignment with the central ventilation aperture formed in the closed top wall.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 8 is a side view of the housing along the second lateral side wall.

FIG. 9 is an end view of the housing along the front side wall.

FIG. 10 is a side view of the base housing structure.

FIG. 11 is a side view of the full length dividing wall.

DESCRIPTION OF THE PREFERRED EMBODIMENTS

Figure 1:
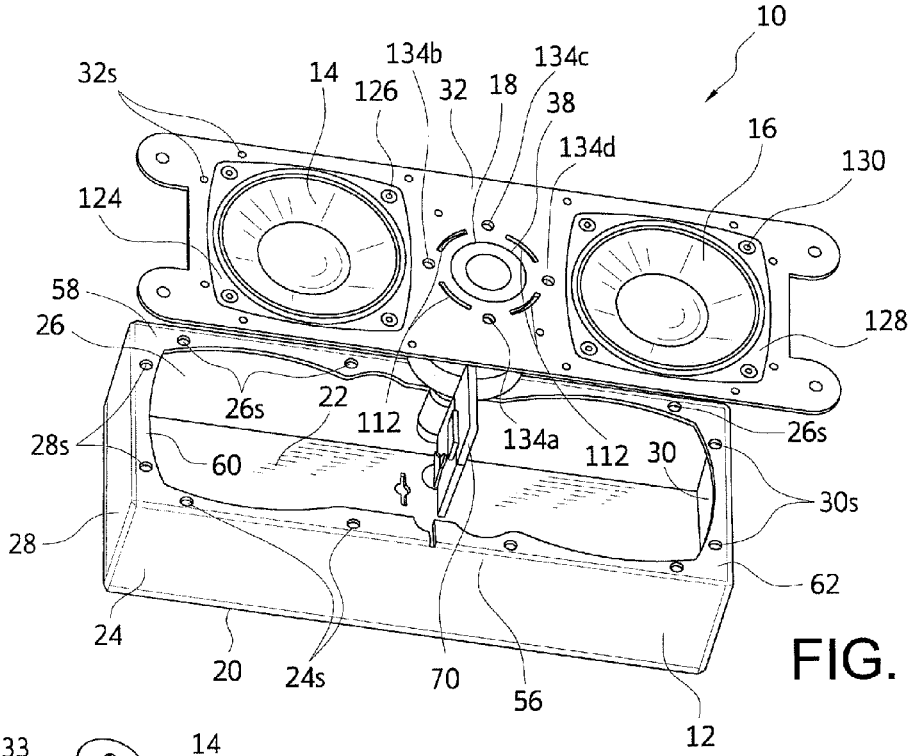
FIG. 1 is a perspective view of the speaker of the present invention with the cover plate removed.
Figure 2:
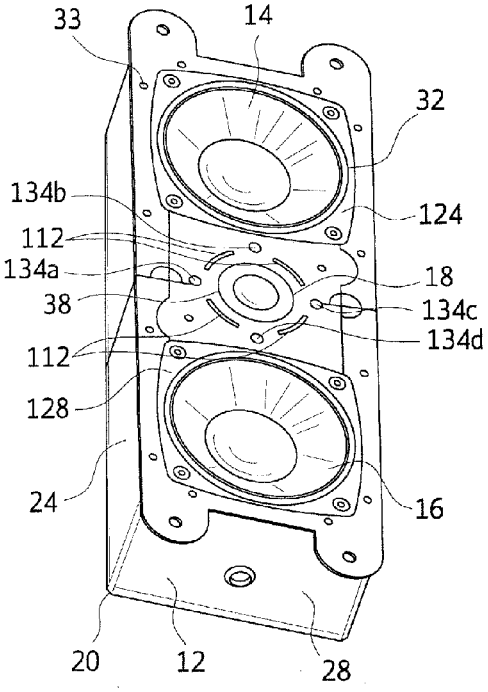
FIG. 2 is a top perspective view of the present speaker assembly.
Figure 3:
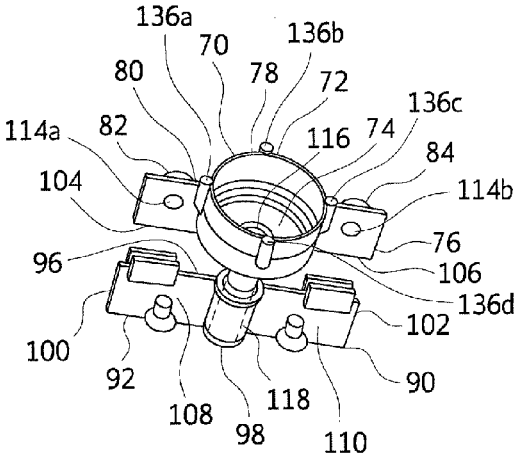
FIG. 3 is an exploded perspective view of the high frequency housing spacer.
Figure 4:
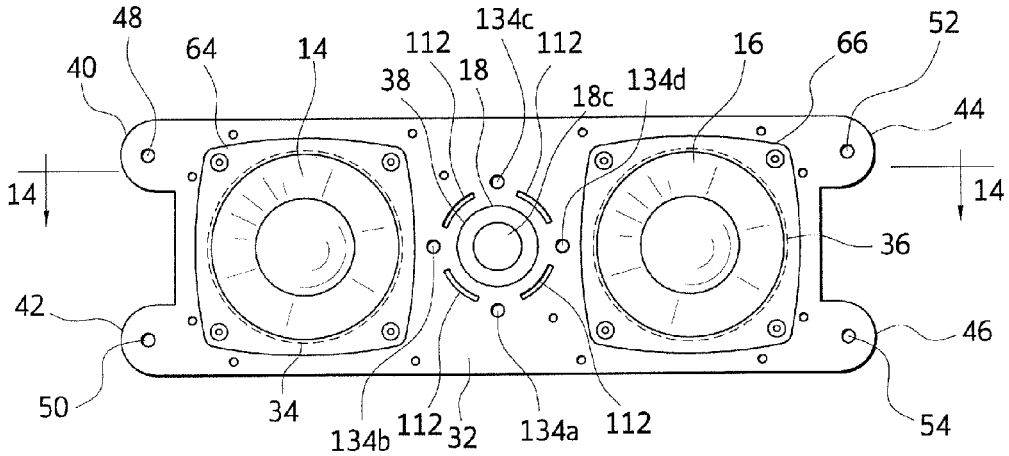
FIG. 4 is a top view of the present speaker assembly.
Figure 5:
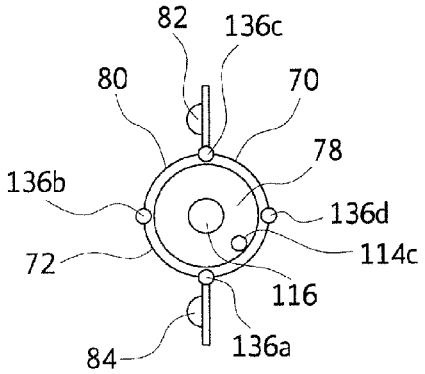
FIG. 5 is a top view of the base housing structure.
Figure 6:
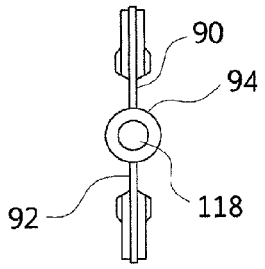
FIG. 6 is a top view of the full length dividing wall.
Figure 7:
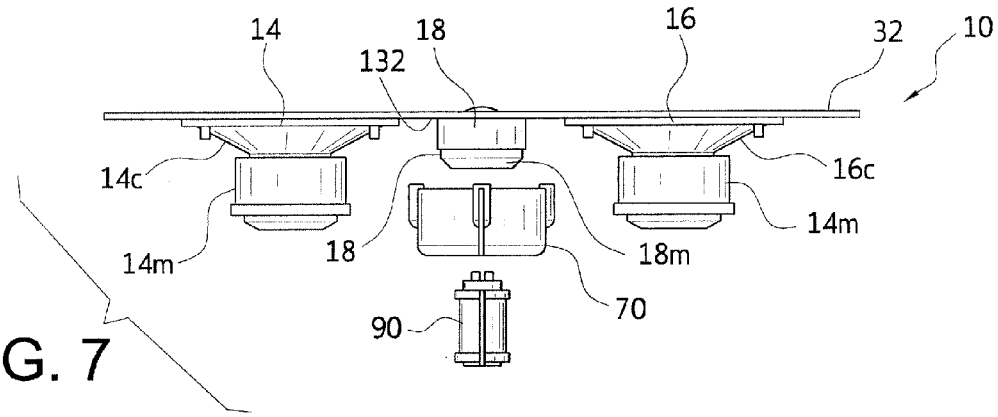
FIG. 7 is an exploded side view of the cover plate, the drivers and the high frequency housing spacer.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to FIGS. 1 to 14, a speaker assembly 10 is disclosed. The speaker assembly 10 incorporates a variety of features which reduce the size and weight of the speaker assembly 10 without compromising the integrity of the sound generated by the speaker assembly 10. The speaker assembly 10 also incorporates various features which improve the cooling thereof and ultimate performance of the speaker assembly 10.

The speaker assembly 10 is primarily intended for use in aircraft, where weight and size are critical. While the speaker assembly 10 is preferably designed for use in aircraft, the speaker assembly 10 may be used in a variety of environments, such as wall and closed room speakers, automotive speakers or within personal computers, without departing from the spirit of the present invention.

As those skilled in the art will appreciate, the present speaker assembly 10 has been disclosed without the wiring commonly employed in conjunction with speakers. As such, a variety of conventional wiring techniques may be employed within the spirit of the present invention.

Briefly, the speaker assembly 10 includes a rigid, structurally stable and self-supporting speaker housing 12 within which a first mid-range driver 14, a second mid-range driver 16 and a high frequency driver 18 are mounted and enclosed. More particularly, the speaker assembly 10 includes a speaker housing 12 with a base structure 20 composed of a closed top wall 22, closed first and second lateral side walls 24, 26 and closed front and rear side walls 28, 30. The stability of the speaker housing 12 is further enhanced through the utilization of full penetration welds in the connection of the various walls thereof. Other than various apertures for the passage of wires, the closed top wall 22, closed first and second lateral side walls 24, 26 and closed front and rear side walls 28, 30 are solid and impervious to the passage of sound waves or airflow.

The speaker housing 12 further includes a cover plate 32 which is selectively secured to the side walls 24, 26, 28, 30 to maintain the first and second mid-range drivers 14, 16 within the speaker housing 12 as described below in greater detail. The speaker housing 12 is preferably constructed from aluminum, although other materials may be employed without departing from the spirit of the present invention. The cover plate 32 is constructed with cover plate apertures 34, 36, 38 shaped and dimensioned for alignment with the cones 14*c*, 16*c* and 18*c* of the drivers 14, 16 and 18. Further, the cover plate 32 is provided with various screw holes 32*s* used in coupling the cover plate 32 to the side walls 24, 26, 28, 30 with, for example, screws 33 passing through both the screw holes 32*s* of the cover plate 32 and the screw holes 24*s*, 26*s*, 28*s*, 30*s* of the inwardly directed flanges 56, 58, 60, 62 of the side walls 24, 26, 28, 30. As will be explained below in greater detail, the cover plate 32 is also provided with air slots 112 and alignment apertures 134*a-d* in the area of the high frequency driver 18.

Other than the cover plate apertures 34, 36, 38, the air slots 112 and various coupling apertures, the cover plate 32 is solid and impervious to the passage of sound waves or airflow. In this way, the speaker housing 12 is a substantially closed enclosure with only the cover plate apertures 34, 36 and 38 and the air slots 112 permitting the passage of sound emitted by the drivers 14, 16 and 18.

In accordance with a preferred embodiment of the present invention, the closed top wall 22 is substantially rectangular, although other shapes may be employed without departing from the spirit of the present invention. Four corner mounts 40, 42, 44, 46 respectively extend from their respective ends of the cover plate 32. Each corner mount 40, 42, 44, 46 includes an aperture 48, 50, 52, 54 adapted for securing the speaker assembly 10 in place. In practice, the corner mounts 40, 42, 44, 46 are attached to a mounting bracket (not shown) of the aircraft. The mounting bracket is adapted to facilitate the installation of the present speaker assembly 10 within an aircraft fuselage.

As briefly mentioned above, the active components of the speaker assembly 10 include the first and second mid-range drivers 14, 16 and the high frequency driver 18. Each of the drivers 14, 16, 18 is of a conventional construction and includes a cone 14*c*, 16*c*, 18*c* with a magnet 14*m*, 16*m*, 18*m* secured thereto. In practice, the cover plate 32 is screwed to the base structure 20, in particular, the cover plate 32 is secured to the exposed inwardly directed flanges 56, 58, 60, 62 of the first and second lateral side walls 22, 24 and the front and rear side walls 26, 28 with screws 33. In this way, the base structure 20 and the cover plate 32 form an enclosure within which the first and second mid-range drivers 14, 16, as well as the high frequency driver 18, are held.

In particular, the first mid-range driver 14 is positioned within the enclosure defined by the cover plate 32 and the base structure 20 such that the interior surface of the cone 14*c* of the first mid-range driver 14 is directed toward, and secured to, the cover plate 32 via a mounting bracket 124 mechanically secured to the cover plate 32, for example, using rivets 126. The first mid-range driver 14 is mounted for alignment with a first cover plate aperture 34 located adjacent a first end 64 of the cover plate 32. In fact, the upper edge of the cone has a radius which is in alignment with an internal edge of the cover plate 32 defining the first cover plate aperture 34 formed in the cover plate 32. The first mid-range driver 14 is mounted such that the interior surface of the cone 14*c* of the first mid-range driver 14 faces the cover plate 32. While a mounting bracket is disclosed above for the secure attachment of the driver to the cover plate, it is appreciated various attachment mechanisms, such as, screws or adhesive (or other coupling structures) may be used to securely attach the first mid-range driver 14 to the cover plate 32.

Similarly, the second mid-range driver 16 is positioned within the enclosure defined by the cover plate 32 and the base structure 20 such that the interior surface of the cone 16*c* of the second mid-range driver 16 is directed toward, and secured to, the cover plate 32 via a mounting bracket 128 mechanically secured to the cover plate 32, for example, using rivets 130. The second mid-range driver 16 is mounted for alignment with a second cover plate aperture 36 located adjacent a second end 66 of the cover plate 32 (opposite the first end 64 of the cover plate 32). In fact, the upper edge of the cone 16*c* has a radius which is in alignment with an internal edge of the cover plate 32 defining the second cover plate aperture 36 formed in the cover plate 32. The second mid-range driver 16 is mounted such that the interior surface of the cone 16*c* of the second mid-range driver 16 faces the cover plate 32. While a mounting bracket is disclosed above for the secure attachment of the drive to the cover plate, it is appreciated various attachment mechanisms, such as, screws or adhesive (or other coupling structures) may be used to securely attach the second mid-range driver 16 to the cover plate 32.

Further, the high frequency driver 18 is positioned within the enclosure defined by the cover plate 32 and the base structure 20 such that the interior surface of the cone 18*c* of the high frequency driver 18 is directed toward, and secured to, the cover plate 32. The high frequency driver 18 is mounted for alignment with a central (or third) cover plate aperture 38 located centrally between the first end 64 and the second end 66 (that is, centrally located between the first cover plate aperture 34 and the second cover plate aperture 36). In fact, the upper edge of the cone 18*c* has a radius which is in alignment with, and adhesively secured to, an internal edge of the cover plate 32 defining the central cover plate aperture 38 formed in the cover plate 32. The high frequency driver 18 is mounted such that the interior surface of the cone 18*c* of the high frequency driver 18 faces the cover plate 32. The exterior upper edge of the cone 18*c* is directly attached to the cover plate 32 about the perimeter of the central cover plate aperture 38 to provide a port for the transmission of sound. Although adhesive coupling is disclosed above, it is appreciated secure attachment may be achieved by using screws or other coupling structures to securely attach the high frequency driver 18 to the cover plate 32.

Because of the nature of midrange-resonance propagation in small enclosures there are inherent benefits in mitigating the midrange resonances of the first and second mid-range drivers 14, 16. In addition, the first and second mid-range drivers 14, 16 also require a minimal amount of space to properly load the drivers. That is, the enclosed space defined by the speaker housing 12 must be of a sufficient size to allow for optimal loading of the first and second mid-range drivers 14, 16 mounted to the respective first cover plate aperture 34 and the second cover plate aperture 36.

The separation of the various drivers 14, 16, 18, without sacrificing the space necessary for loading and cooling, is achieved by the provision of a high frequency housing spacer 70 secured around the high frequency driver 18. In particular, the high frequency housing spacer 70 includes a base housing structure 72 composed of a closed top wall 74, a cylindrical side wall 76 extending from the closed top wall 74, and an open bottom 78 (thereby defining a "cup like" configuration in which the high frequency driver 18 may fit). In practice, and as will be appreciated based upon the following disclosure, the bottom edge 80 of the cylindrical side wall 76 is secured to the inner wall 132 of the cover plate 32 in the area surrounding the high frequency driver 18. In this way, the open bottom 78 is covered by the inner wall 132 of the cover plate 32 to enclose the space defined by the high frequency housing spacer 70.

The high frequency housing spacer 70 also includes first and second dividing walls 82, 84 extending from diametrically opposed sides of the cylindrical side walls 76 of the high frequency housing spacer 70. When fully assembled within the speaker housing 12, the first and second dividing walls 82, 84 extend from the base housing structure 72 to the first and second lateral side walls 24, 26 of the speaker housing 12.

In order to complete the separation of the speaker housing 12 into compartments for the first and second mid-range drivers 14, 16, a full length dividing wall 90 is positioned beneath the high frequency housing spacer 70. The full length dividing wall 90, therefore, includes a wall structure with first and second surfaces 92, 94, a bottom edge 96, a top edge 98, and first and second side edges 100, 102. The bottom edge 96 is shaped and dimensioned for engagement with the top edges 104, 106 of the first and second dividing walls 82, 84, as well as the closed top wall 74 of base housing structure 72. Alignment is facilitated by the provision of guiding slots 108, 110 formed along the bottom edge 96 of the full length dividing wall 90. The top edge 98 is shaped and dimensioned for engagement with the closed top wall 22 of the speaker housing 12. Finally, the first and second side edges 100, 102 engage the first and second lateral side walls 24, 26 of the speaker housing 12. In this way, the high frequency housing spacer 70 and the full length dividing wall 90 create a separating wall between the first mid-range driver 14 and the second mid-range driver 16.

Given that the high frequency driver 18 is contained within a limited space defined by the cover plate 32 and the base housing structure 72 of the high frequency speaker housing 70, it is necessary to provide air flow for cooling of the high frequency driver 18. This is achieved by the provision of air slots (or holes) 112 formed in the cover plate 32 in the area of, and in fluid communication with, the cavity defined by the cover plate 32 and the base housing structure 72 of the high frequency housing spacer 70. In accordance with a preferred embodiment, the air slots 112 are arcuate members symmetrically positioned about the cover plate aperture 38. For example, and as shown with reference to FIGS. 1, 2 and 4, four air slots 112 are provided and each of the air slots 112 extends about an arc of approximately 45°.

The high frequency housing spacer 70 and the full length dividing wall 90 provide additional functionality with the provision of wire feedthroughs 114*a-c* and a ventilation channel 116, 118. In particular, the wire feedthroughs 114 allow for the passage of wires to the high frequency driver 18, first mid-range driver 14 and the second mid-range driver 16. As for ventilation, the base housing structure 72 is provided with a central ventilation aperture 116 in the closed top wall 74 and the full length dividing wall 90 is provided with a ventilation aperture 118 shaped and dimensioned for alignment with the central ventilation aperture 116 formed in the closed top wall 74. The ventilation aperture 118 of the full length dividing wall 90 extends from top edge 98 and the bottom edge 96 of the full length dividing wall 90. Accordingly, air may freely flow between the air slots 112, the central ventilation aperture 116 in the closed top wall 74 of the base housing structure 72, the ventilation aperture 118 of the full length dividing wall 90, and an alignment slot 138*b* (discussed below) formed in the closed top wall 22 of the speaker housing 12.

Proper alignment of the high frequency housing spacer 70 within the speaker housing 12 is achieved through the provision of various alignment projections and alignment apertures in the cover plate 32, the closed top wall 22 and the high frequency housing spacer 70. In particular, the cover plate 32 is provided with four alignment apertures 134*a-d* symmetrically positioned about the cover plate aperture 38 for the high frequency driver 18. The alignment apertures 134*a-d* are shaped and dimensioned to receive alignment projections 136*a-d* extending from the base housing structure 72. The alignment projections 136*a-d* extend from the cylindrical side wall 76 at the bottom edge 80 of the cylindrical side wall 76 for positioning within the respective alignment holes of the cover plate 32.

Figure 12:
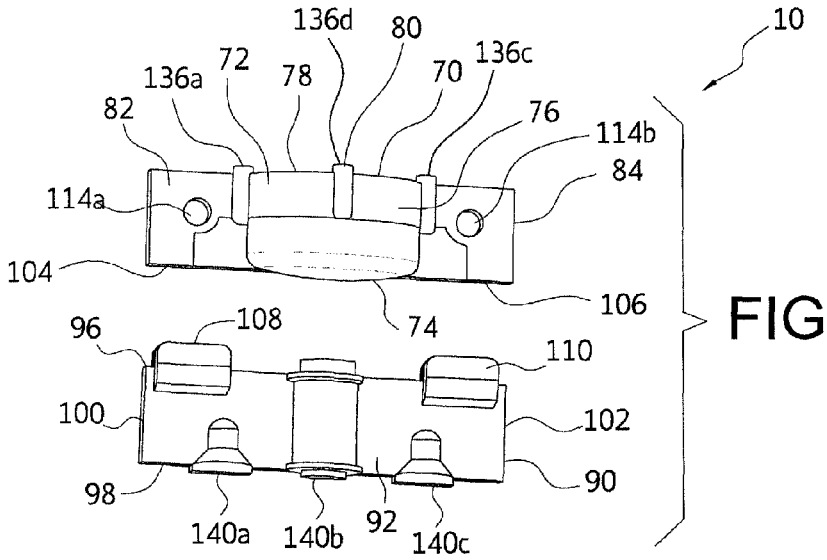
FIG. 12 is a side view of the exploded high frequency housing spacer composed of the base housing structure and the full length dividing wall.
Figure 13:
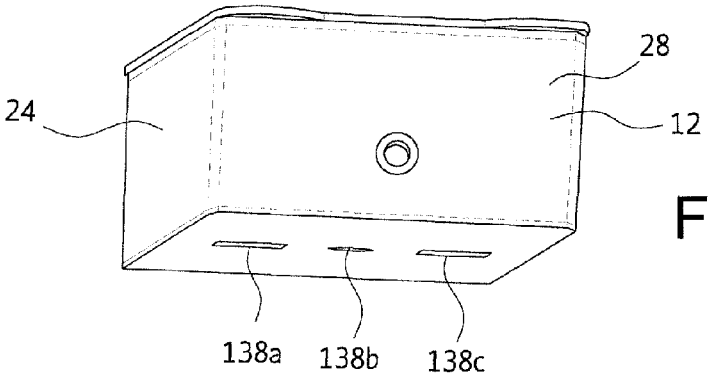
FIG. 13 is a bottom perspective view of the housing along the rear side wall.
Figure 14:
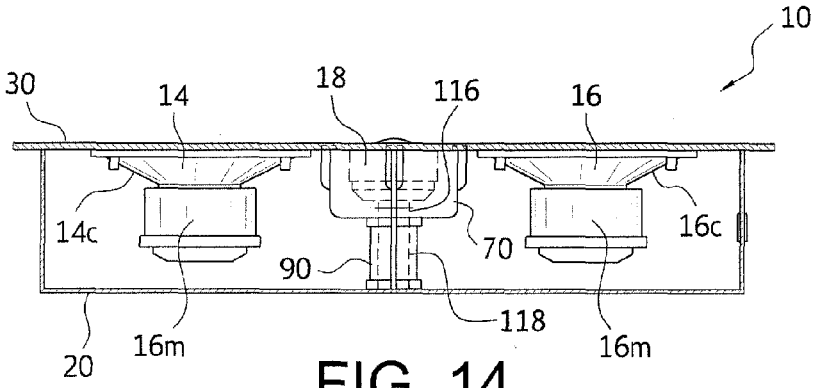
FIG. 14 is a cross-sectional view along the line 14-14 of FIG. 4.

As best seen in FIGS. 12 and 13, the closed top wall 22 is provided with three alignment slots 138*a-c* shaped and dimensioned to receive alignment projections 140*a-c* extending from the frill length dividing wall 90 of the high frequency housing spacer 70. The alignment projections 140*a-c* extend from the top edge 96 of the full length dividing wall 90 for positioning within the respective alignment slots 138*a-c* of the closed top wall 22. In order for the ventilation aperture 118 of the full length dividing wall 90 to allow for the flow of air as described above, the alignment projection 140*b* in alignment with the ventilation aperture 118 is circular, while the alignment projections 140*a*, 140*c* are of an elongated shape (and the alignment slots 138*a-c* are shaped for receipt of the respective alignment projections 140*a-c*).

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A speaker assembly, comprising:

a rigid, structurally stable and self-supporting speaker housing:

a first mid-range driver mounted within the speaker housing;

a second mid-range driver mounted within the speaker housing;

a high frequency driver mounted within the speaker housing;

a high frequency housing spacer secured around the high frequency driver and positioned within the speaker housing to divide the speaker housing into separate and distinct compartments for the high frequency driver, the first mid-range driver and second mid-range driver, wherein the high frequency housing spacer includes a base housing structure composed of a top wall, a side wall extending from the top wall, and an open bottom, and the high frequency housing spacer also includes first and second dividing walls extending from diametrically opposed sides of the side wall.

2. The speaker assembly according to claim 1, further including a full length dividing wall positioned beneath the high frequency housing spacer.

3. The speaker assembly according to claim 2, wherein the full length dividing wall includes a wall structure with first and second surfaces, a bottom edge, a top edge, and first and second side edges.

4. The speaker assembly according to claim 1, wherein the speaker housing includes a base structure composed of a top wall, first and second lateral side walls and front and rear side walls.

5. The speaker assembly according to claim 4, wherein, other than various apertures for passage of wires, the top wall, first and second lateral side walls and front and rear side walls are solid and impervious to the passage of sound waves or airflow.

6. The speaker assembly according to claim 4, wherein the speaker housing further includes a cover plate selectively secured to the first and second lateral side walls and front and rear side walls such that the base structure and the cover plate form an enclosure within which the first and second mid-range drivers, as well as the high frequency driver, are held.

7. The speaker assembly according to claim 6, wherein the cover plate includes air slots in fluid communication with a cavity defined by the cover plate and the high frequency housing spacer.

8. The speaker assembly according claim 6, wherein a bottom edge of the side wall is secured to an inner wall of the cover plate in a manner surrounding the high frequency driver and the first and second dividing walls extending from the base housing structure to the first and second lateral side walls of the speaker housing.

9. The speaker assembly according to claim 6, further including a full length dividing wall positioned beneath the high frequency housing spacer.

10. The speaker assembly according to claim 9, wherein the full length dividing wall includes a wall structure with first and second surfaces, a bottom edge, a top edge, and first and second side edges.

11. The speaker assembly according to claim 10, wherein the base housing structure includes a central ventilation aperture in the closed top wall and the full length dividing wall is provided with a ventilation aperture shaped and dimensioned for alignment with the central ventilation aperture formed in the closed top wall.

12. The speaker assembly according to claim 10, wherein the cover plate includes air slots in fluid communication with a cavity defined by the cover plate and the high frequency housing spacer.

13. The speaker assembly according to claim 12, wherein the base housing structure includes a central ventilation aperture in the closed top wall and the full length dividing wall is provided with a ventilation aperture shaped and dimensioned for alignment with the central ventilation aperture formed in the closed top wall.

* * * * *